US005592928A

United States Patent [19]

Frasier

[11] Patent Number: 5,592,928

[45] Date of Patent: Jan. 14, 1997

[54] ARCHERY PRACTICE DEVICE

[76] Inventor: William P. Frasier, 3980 Sheep Ranch Rd., Rhinelander, Wis. 54501

[21] Appl. No.: 614,268

[22] Filed: Mar. 12, 1996

[51] Int. Cl.[6] ..... F41B 5/00

[52] U.S. Cl. ..... 124/1; 482/12; 482/122

[58] Field of Search ..... 124/1, 20.1, 20.3, 124/23.1, 25, 87; 482/12, 121, 122, 131

[56] References Cited

U.S. PATENT DOCUMENTS

| | | | |
|---|---|---|---|
| D. 353,182 | 12/1994 | Rubin | D22/106 |
| 2,351,103 | 6/1944 | Brown | 124/87 X |
| 4,090,706 | 5/1978 | Reda | 482/122 |
| 4,279,601 | 7/1981 | Cobelli | 434/247 |
| 4,373,503 | 2/1983 | Saunders | 124/20.1 |
| 4,458,658 | 7/1984 | Blair | 124/20.1 |
| 4,609,191 | 9/1986 | Remme | 482/122 |
| 4,623,145 | 11/1986 | Paraskevakos | 482/112 |
| 4,708,341 | 11/1987 | Paraskevakos | 482/120 |
| 5,277,170 | 1/1994 | Carella | 124/86 |

FOREIGN PATENT DOCUMENTS

| | | | |
|---|---|---|---|
| 2262019 | 6/1993 | United Kingdom | 124/20.1 |

*Primary Examiner*—John A. Ricci

*Attorney, Agent, or Firm*—Whyte Hirschboeck Dudek S.C.

[57] ABSTRACT

An archery practice device is disclosed in which an experienced or a student archer can improve upon and learn the skills necessary for effective archery, and increase body strength for endurance with the use of a compact practice device. The archery practice device of the present invention includes a handgrip member having a pair of parallel guide members attached to the handgrip member and extending perpendicularly from a longitudinal length of the handgrip member. The device also includes a pair of elastic cords having one end of each cord attached to the handgrip member though the pair of guide members, and a bowstring attached to the other end of the elastic cords. The archery practice device further includes a sighting pin and is weighted to simulate the weight of a compound bow. In practice, the archer can concentrate on aiming and releasing without worrying that the elastic cords will slap the hand holding the gripping member.

8 Claims, 1 Drawing Sheet

FIG. 1
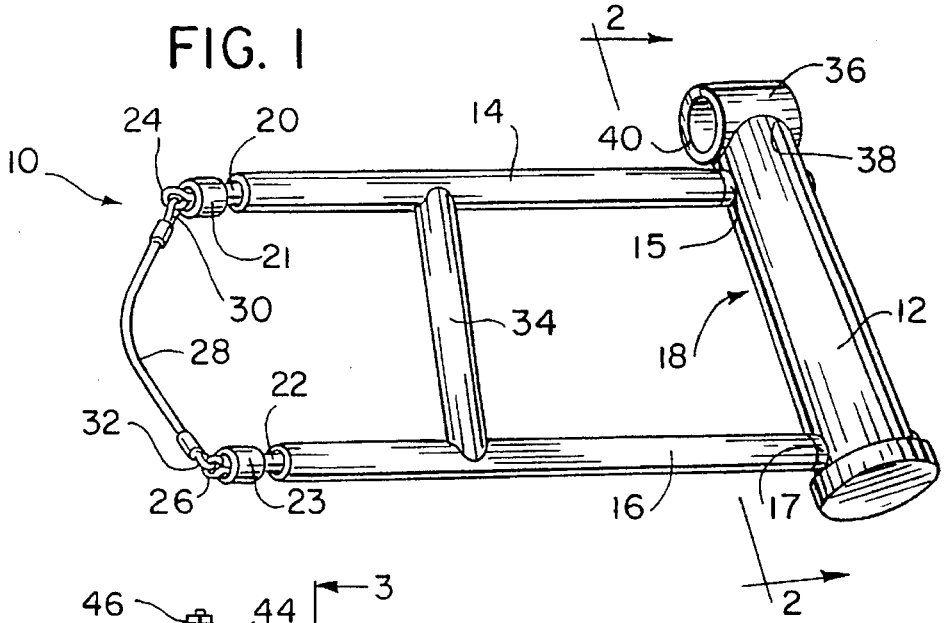
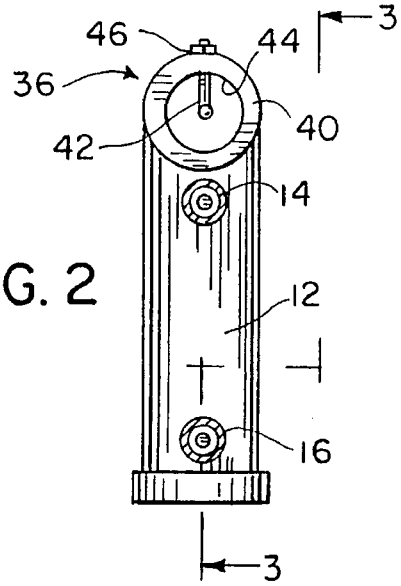
FIG. 2
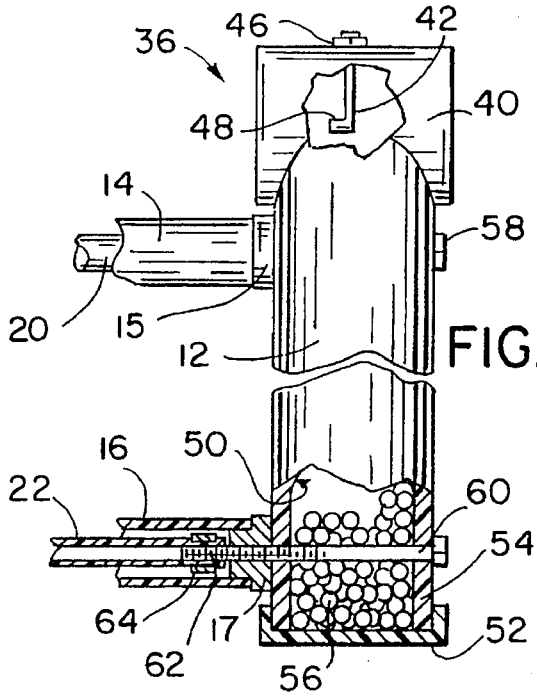
FIG. 3
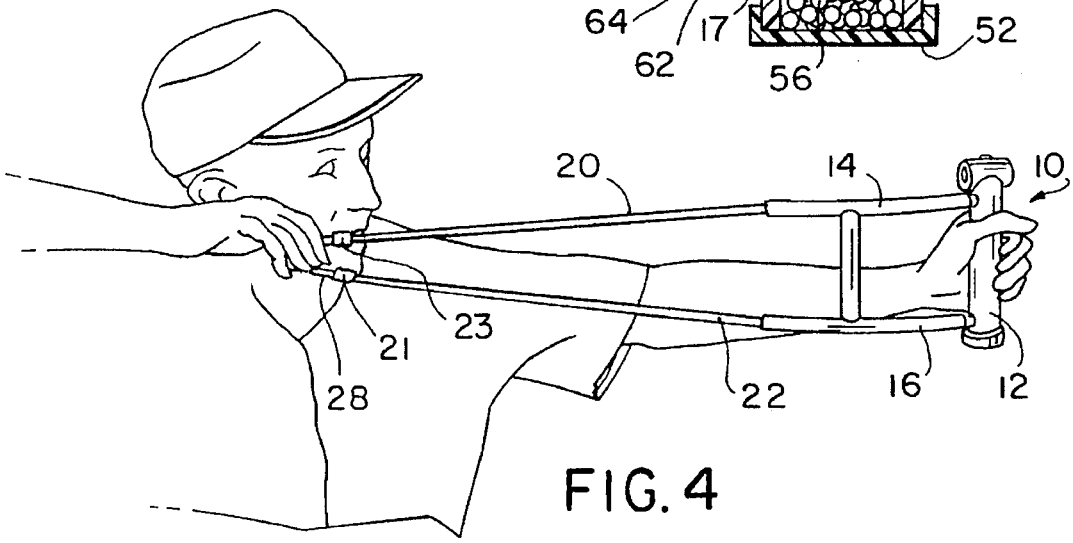
FIG. 4

ARCHERY PRACTICE DEVICE

BACKGROUND OF THE INVENTION

The invention relates to archery in general, and more particularly to an archery practice device usable with or without an archery trigger release allowing an archer to practice the skills of archery without the use of an actual bow.

As is well known by archery professionals, a bow cannot be shot dry, that is without an arrow, because without the weight of an arrow either the bowstring or the bow will break. Since the professional archer likes to shoot at least a hundred shots a day to maintain top form, and the weekend shooter always needs to sharpen his skills, the need has existed for an archery practice device that can be used in the backyard, or in the home. This need is amplified by the limited number of archery ranges available. It would be desirable to have a device that simulates the tension of a compound bow when drawn back while allowing aiming at some distant target, and being able to release the device while calling the shot just as one would on the archery range with an actual bow and arrow.

Several attempts have been made to provide such a device, but have fallen short of providing all the necessary criteria.

For example, U.S. Pat. No. 4,279,601 issued to Cobelli discloses an archery trainer and exercise device having a handgrip, an elastic cord connected to the handgrip, and a sighting rod extending upward from the handgrip. Although such a device is effective at exercising the necessary muscle groups for proper archery techniques, it does not provide for releasing the extended elastic cord in simulation of shooting an arrow with a compound bow. It is readily apparent that if the elastic cord of the Cobelli reference were released suddenly, as in the motion required for shooting an arrow, the elastic cord would snap toward the archer's hand holding the training device and possibly cause injury. Also, the Cobelli device would not accommodate the use of an archer's trigger release.

Another archery exercising device is disclosed in U.S. Pat. No. 4,609,191 issued to Remme which has a continuous loop of slow recovery elastic belting passing through a tubular grip at one side, and through a string block or rod at the other side. The string block is provided with a means for attaching a bowstring simulator. For similar reasons as Cobelli, the Remme device provides a good source of strengthening the muscle groups used in drawing and holding a bow, but does not provide any means for a quick release to simulate the shooting of an arrow from a bow while maintaining the target within a sight.

It would be desirable to have a device that not only strengthens the muscle groups used in archery, but also provide for releasing while concentrating on sighting the target within the bow sight, and capable of using an archer's trigger release.

SUMMARY OF THE INVENTION

The present invention overcomes the shortcomings of the prior art devices and satisfies the aforementioned needs. The archery practice device of the present invention provides a means to strengthen and maintain the muscle groups for steady and efficient archery, while also providing a means for allowing quick release of the retracted archery practice device to simulate the shooting of an arrow with a compound bow, and allows the use of an archer's trigger release.

In accordance with one aspect of the invention, an archery practice device is disclosed having a handgrip member and a pair of parallel guide members attached to the handgrip member and extending perpendicularly from the longitudinal length of the handgrip member. A pair of elastic cords are attached at one end to the handgrip member through the guide members. A bowstring is attached to the other end of the elastic cords, and a sighting pin is provided for simulating the alignment of an arrow with a target.

A stabilizer member is used for stabilizing the pair of guide members and is attached between the guide members. The handgrip member is preferably a hollow tube which can be filled with a weighting material, such as lead shot, to simulate the weight of a compound bow.

The device of the present invention will enable an archer, or prospective archer, to draw back on the bowstring, practice aiming, hold the sight on the target, and release the bowstring as if the archer were releasing an arrow from a bow. The release may be either by finger release, or with a release aid, such as an archer's trigger release.

Various other features, objects, and advantages of the invention will be made apparent from the following detailed description, taken together with the drawings.

BRIEF DESCRIPTION OF THE DRAWINGS

The drawings illustrate the best mode presently contemplated for carrying out the invention.

In the drawings:

FIG. 1 is a side perspective view of the archery practice device of the present invention.

FIG. 2 is a sectional view taken along line 2—2 of FIG. 1.

FIG. 3 is a partial sectional view taken along line 3—3 of FIG. 2.

FIG. 4 is a perspective view of the present invention in use.

DETAILED DESCRIPTION OF THE PREFERRED EMBODIMENT

FIG. 1 shows an archery practice device 10 having a handgrip member 12 and a pair of parallel guide members 14, 16 attached to the handgrip member 12 and extending perpendicularly from a longitudinal length 18 of the handgrip member 12. Alternatively, handgrip member 12 could be formed with a curving feature to simulate the portion of a bow grip to match the archers hand. The archery practice device 10 also has a pair of elastic cords 20 and 22, best shown in FIG. 4, each having a first end attached to the handgrip member 12 through the pair of guide members 14 and 16. Preferably, the elastic cords are made of readily available surgical tubing. The elastic cords 20 and 22 are fitted with eyelets 24 and 26, respectively, for attaching a bowstring 28 to a second end of the elastic cords 20 and 22. Bowstring 28 is a shortened version of a typical actual bowstring with eyelets 30 and 32 fastened to the ends of bowstring 28 for attachment to elastic cords 20 and 22 through eyelets 24 and 26.

A pair of adaptors 15 and 17 may be used to fit guide members 14 and 16 to handgrip member 12, as best shown in FIG. 3. A pair of elastic cord protectors 21 and 23 are fitted over the elastic cords 20 and 22, respectively, to prevent damage to the elastic cords when the cords are retracted into the pair of guide member 14 and 16 after being stretched outwardly and released.

The handgrip member 12 has a sight assembly 36 at an upper end 38 which is formed arcuately to receive sight assembly 36. Preferably, sight assembly 36 is comprised of a tube section 40 having a longitudinal direction parallel to that of the pair of guide members 14 and 16.

Referring to FIG. 2, the handgrip member 12 is shown along line 2—2 of FIG. 1. The sight assembly 36 is shown comprised of the tube section 40 and a sight pin 42 centered in a bore 44 of tube section 40. Sight pin 42 is threadedly engaged in tube section 40 and retained therein with a locking nut 46.

FIG. 3 shows a partially cut-away side view of FIG. 2 taken along lines 3—3. To provide a better reference in practice sighting, sight pin 42 is preferably brightly colored and provided with a sight extension 48 extending parallel with the longitudinal direction of tube section 40 to provide more accurate sighting.

FIG. 3 also shows that preferably, the handgrip member 12 is comprised of a tube having an inside bore 50 and a cap 52 on a lower end 54 of handgrip member 12. In this manner, the handle grip member 12 can be filled with a weighting material 56, such as lead shot, to accomplish a desired weight. Preferably, the archery practice device 10 is weighted to simulate the weight of an actual bow. Since actual bow weights vary, the user can modify the amount of weighting material, and the type of weighting material to achieve a desired weight. For example, to achieve a weight of approximately 2.5 lbs., the hand grip can be filled with poured hot lead.

One method of attaching the elastic cords 20 and 22 to the handgrip member 12 is illustrated in FIG. 3. The handgrip member 12 is drilled to receive bolts 58 and 60, and the elastic cords 20 and 22 are fitted over the threaded ends of the bolts and fastened with clamps. Elastic cord 22 is shown attached to the threaded end 62 of bolt 60 with a clamp 64.

Referring to FIG. 4, the archery practice device 10 of the present invention is shown in use, wherein an archer is shown in a target sighting stance. Since the archery practice device of the present invention is equipped with an actual bowstring, an archer's trigger release 65 may be used, such as a Winn Free Flight™, or any of the many commercially available release aids. Such a device aids in maintaining a steady bow and bowstring during release, and offers quick and positive release by means of a trigger. The archer's trigger release 65 is releasably attached to the bowstring 28, and the archer can quickly and accurately release the bowstring 28 by actuating the trigger of the trigger release 65. Alternatively, the bowstring 28 can be grasped by the archer in a typical three finger grasp of the dominant hand, while retaining the handgrip member 12 in the other hand.

In either case, the archer retracts the bowstring 28, pulling the elastic cords 20 and 22 rearward and stretching the cords out of guide members 14 and 16. After the bowstring 28 is drawn back toward the archer's jaw or chin, the archer aligns the sight in the archery practice device with a distant target. The archer then works at maintaining that sight while steadying the archery practice device to strengthen the muscle groups necessary for improved archery performance. When desired, the archer may release the bowstring and call his shot. In this manner, the present invention allows the archer to concentrate on maintaining the proper sight alignment, and disregarding any concern that the bowstring or elastic cord may strike the archer's hand since the cords are retracted into the guides upon release.

The holding tension on the present invention is approximately 13 to 17 pounds to match that of a compound bow with a 65% let-off. This permits not only an experienced archer to use the present invention for improving his/her skills, a beginner can use the invention to learn how to properly draw a bow back in a smooth and steady fashion. Both the experienced and the student archer are able to regularly practice his/her skills virtually anywhere with the present invention. The archer is able to master the proper archery position while sighting a target, and is able to practice holding that position steady for an extended period of time, as is necessary to properly sight and hit a target.

The present invention has been described in terms of the preferred embodiment, and it is recognized that equivalents, alternatives, and modifications, aside from those expressly stated, are possible and within the scope of the appending claims.

I claim:

1. An archery practice device comprising:

a handgrip member;

a pair of parallel rigid guide members attached to the handgrip member and extending perpendicularly from a longitudinal length of the handgrip member;

a pair of elastic cords each attached at one end to the handgrip member through the pair of guide members; and a bowstring attached to a second end of each of the pair of elastic cords.

2. The archery practice device of claim 1 further comprising at least one stabilizer member for stabilizing the pair of guide members.

3. The archery practice device of claim 2 wherein the stabilizer member is attached to each of the pair of guide members and is located therebetween.

4. The archery practice device of claim 1 further comprising a sight on an upper end of the handgrip member.

5. The archery practice device of claim 4 wherein the sight comprises a tube section having a longitudinal direction parallel to that of the pair of guide members, and further comprising a sight pin centered in a bore of the tube section.

6. The archery practice device of claim 1 further comprising a pair of elastic cord protectors, wherein each elastic cord is placed through the elastic cord protectors such that the elastic cord protectors prevent damage to the elastic cord as the cords are retracted into the pair of guide members after being stretched outwardly.

7. The archery practice device of claim 1 wherein the handgrip member is a tube having a cap on a lower end and being at least partially filled with a weighting material to accomplish a desired weight.

8. A method of practicing archery comprising the steps of:

retracting a bowstring attached to a pair of elastic cords threaded through a pair of rigid guide members that are attached to a handgrip;

retaining the handgrip with a force opposite of that necessary in the step of retracting;

aligning a sight with a target;

maintaining the sight and steadying the handgrip and bowstring; and releasing the bowstring while concentrating on maintaining the proper sight alignment.

* * * * *

UNITED STATES PATENT AND TRADEMARK OFFICE

CERTIFICATE OF CORRECTION

PATENT NO. : 5,592,928

DATED : January 14, 1997

INVENTOR(S) : William P. Frasier

It is certified that error appears in the above-identified patent and that said Letters Patent is hereby corrected as shown below:

The title page showing an illustrative figure should be deleted and substitute therefor the attached title page.

In the drawings, Fig. 4, should be deleted to be replaced with the corrected Fig. 4, as shown on the attached page.

United States Patent [19]

Frasier

[11] Patent Number: 5,592,928

[45] Date of Patent: Jan. 14, 1997

[54] ARCHERY PRACTICE DEVICE

[76] Inventor: William P. Frasier, 3980 Sheep Ranch Rd., Rhinelander, Wis. 54501

[21] Appl. No.: 614,268

[22] Filed: Mar. 12, 1996

[51] Int. Cl.[6] ..... F41B 5/00

[52] U.S. Cl. ..... 124/1; 482/12; 482/122

[58] Field of Search ..... 124/1, 20.1, 20.3, 124/23.1, 25, 87; 482/12, 121, 122, 131

[56] References Cited

U.S. PATENT DOCUMENTS

| | | | |
|---|---|---|---|
| D. 353,182 | 12/1994 | Rubin | D22/106 |
| 2,351,103 | 6/1944 | Brown | 124/87 X |
| 4,090,706 | 5/1978 | Reda | 482/122 |
| 4,279,601 | 7/1981 | Cobelli | 434/247 |
| 4,373,503 | 2/1983 | Saunders | 124/20.1 |
| 4,458,658 | 7/1984 | Blair | 124/20.1 |
| 4,609,191 | 9/1986 | Remme | 482/122 |
| 4,623,145 | 11/1986 | Paraskevakos | 482/112 |
| 4,708,341 | 11/1987 | Paraskevakos | 482/120 |
| 5,277,170 | 1/1994 | Carella | 124/86 |

FOREIGN PATENT DOCUMENTS

| | | | |
|---|---|---|---|
| 2262019 | 6/1993 | United Kingdom | 124/20.1 |

*Primary Examiner*—John A. Ricci

*Attorney, Agent, or Firm*—Whyte Hirschboeck Dudek S.C.

[57] ABSTRACT

An archery practice device is disclosed in which an experienced or a student archer can improve upon and learn the skills necessary for effective archery, and increase body strength for endurance with the use of a compact practice device. The archery practice device of the present invention includes a handgrip member having a pair of parallel guide members attached to the handgrip member and extending perpendicularly from a longitudinal length of the handgrip member. The device also includes a pair of elastic cords having one end of each cord attached to the handgrip member though the pair of guide members, and a bowstring attached to the other end of the elastic cords. The archery practice device further includes a sighting pin and is weighted to simulate the weight of a compound bow. In practice, the archer can concentrate on aiming and releasing without worrying that the elastic cords will slap the hand holding the gripping member.

8 Claims, 1 Drawing Sheet

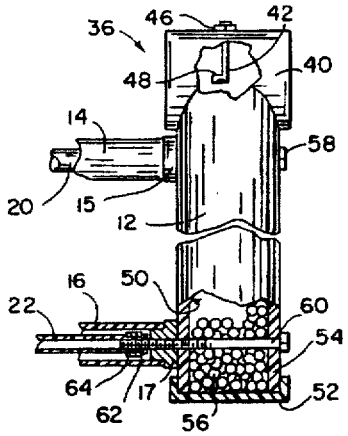

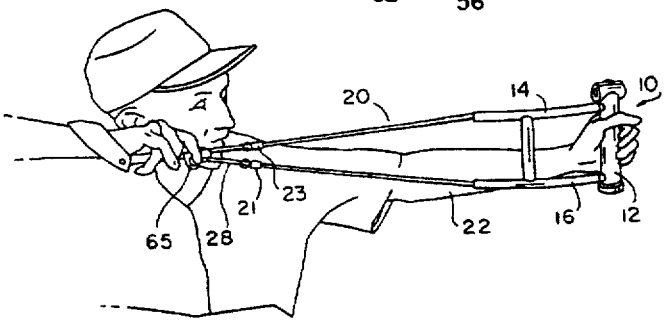

UNITED STATES PATENT AND TRADEMARK OFFICE

CERTIFICATE OF CORRECTION

PATENT NO. : 5,592,928

DATED : January 14, 1997

INVENTOR(S) : Frasier

It is certified that error appears in the above-indentified patent and that said Letters Patent is hereby corrected as shown below:

Fig. 4 should be replaced by the figure below.

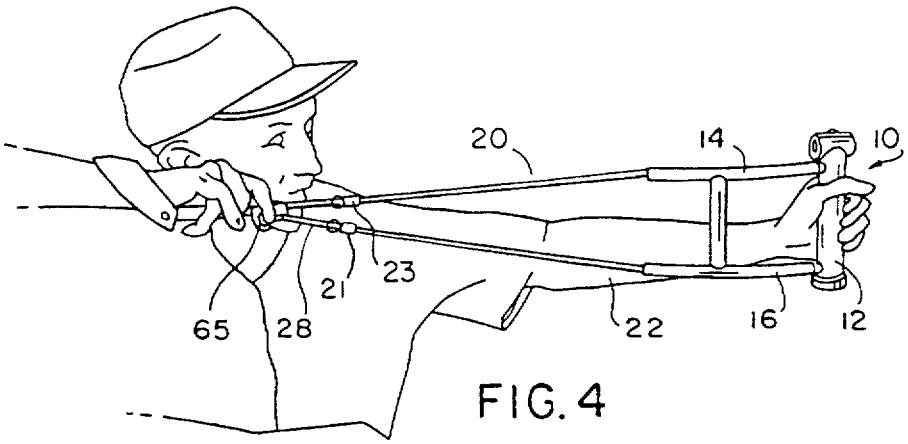

FIG. 4

Signed and Sealed this

Thirteenth Day of May, 1997

Bruce Lehman

*Attest:*

BRUCE LEHMAN

*Attesting Officer*

*Commissioner of Patents and Trademarks*